US012601179B2

(12) United States Patent
Packard

(10) Patent No.: US 12,601,179 B2
(45) Date of Patent: Apr. 14, 2026

(54) SYSTEMS AND METHODS RELATED TO SNOW REMOVAL

(71) Applicant: POLAR VORTEX LLC, Sarasota, FL (US)

(72) Inventor: George A. Packard, Antigo, WI (US)

( * ) Notice: Subject to any disclaimer, the term of this patent is extended or adjusted under 35 U.S.C. 154(b) by 4 days.

(21) Appl. No.: 18/724,537

(22) PCT Filed: Jan. 18, 2023

(86) PCT No.: PCT/US2023/060833
§ 371 (c)(1),
(2) Date: Jun. 26, 2024

(87) PCT Pub. No.: WO2023/141461
PCT Pub. Date: Jul. 27, 2023

(65) Prior Publication Data

US 2025/0067054 A1 Feb. 27, 2025

Related U.S. Application Data

(60) Provisional application No. 63/300,481, filed on Jan. 18, 2022.

(51) Int. Cl.
*E04D 13/10* (2006.01)
*E01H 5/08* (2006.01)

(52) U.S. Cl.
CPC ..... *E04D 13/106* (2013.01); *E01H 5/08* (2013.01)

(58) Field of Classification Search
None
See application file for complete search history.

(56) References Cited

U.S. PATENT DOCUMENTS 3,998,486 A 12/1976 Mittelstadt
6,202,329 B1 3/2001 Supplee et al.
6,643,958 B1 11/2003 Krejci
D897,793 S * 10/2020 Ramsey ..... D8/10

OTHER PUBLICATIONS

International Search Report and Written Opinion of the ISA, dated Jun. 2, 2023, from related PCT Application Serial No. PCT/US2023/60833, Filed Jan. 19, 2023, 8 pages.

* cited by examiner

*Primary Examiner* — Eric W Golightly
(74) *Attorney, Agent, or Firm* — Smith Keane LLP

(57) ABSTRACT

A snow rake device comprises an open shape rake head operatively coupled to a gear assembly, handle assembly, and motor. The motor drives a flex shaft to rotate, which is pinioned into a linear reciprocating motion by the gear assembly, causing the rake head to move in opposite distal and proximal directions. Cutting bars on the rake head may then break up compacted snow and ice to more efficiently clear a building roof from snow.

20 Claims, 8 Drawing Sheets

SYSTEMS AND METHODS RELATED TO SNOW REMOVAL

RELATED APPLICATIONS

This application is a national phase application from International Patent Application Ser. No. PCT/US2023/060833, filed Jan. 18, 2023, and entitled "Systems and Methods Related to Snow Removal," which claims priority to U.S. Provisional Patent Application Ser. No. 63/300,481, filed Jan. 18, 2022, and entitled "Systems and Methods Related to Snow Removal," both of which are incorporated by reference herein in their entireties.

BACKGROUND OF THE INVENTION

Winter can be a difficult time for many reasons, not the least of which may be snow accumulation. Whether it be the cause of traffic accidents or school closures, snow accumulation causes problems and delays for millions of people every year. Such problems and delays may even turn into dangerous situations. For example, snow accumulation on a rooftop can be dangerous in both commercial and residential buildings. Especially for older roofs, where the risk of poor structural integrity is higher, a build-up of snow may lead to collapses or cave-ins that have the potential to cause serious harm to people and property.

To effectively combat the threat of roof collapse, it may be necessary to clear accumulated snow from a roof. In the past, clearing snow has been accomplished by simply climbing onto a roof and using a snow shovel to physically push snow away. However, this method may be dangerous, as it involves climbing onto an already possibly weight limited roof. The clearer may also risk slipping and falling during the shoveling process. Thus, improved methods of clearing snow off a roof were sought.

One of the more popular methods that was developed was a long pole with a wide, solid head at the end that a user could hoist onto a roof and pull down on to clear snow. Commonly called a snow rake, this invention allowed a user to remain on the ground, which reduced the chance of injury. However, this method could be arduous and time consuming, as the user could not clear much snow at a time, thus they would have to periodically work their way up a roof section bit by bit.

More recently, newer forms of snow rakes have emerged, wherein the solid rake head was replaced by a metal frame that would allow snow to pass through as it moved up the roof. In addition, a plastic tarp was attached to the rake head, which reduced friction and allowed snow to slide down the roof as the rake head frame was pushed along the roof. However, even this improved snow rake requires a user to manually thrust the rake head through the accumulated snow, which may be difficult for users, especially when snow build-up is at its highest levels. Thus, an improved snow rake device and method that reduces risks of potential injury while being efficient and easy to use is desired.

SUMMARY OF THE INVENTION

Systems and methods according to the present invention relate generally to snow removal tools, and more particularly to devices used for clearing snow from a sloped roof. In particular, the present invention relates to a device to efficiently clear snow off a roof using a reciprocating rake head.

An embodiment of a snow rake system according to the present invention includes a distal rake head including a plurality of cutting bars fixed to a yoke frame and a pinion gear assembly having a rotational input side and a linear output side, the linear output side operatively coupled to the yoke frame. The embodiment also includes a motor operatively coupled to the rotational input side and a proximal handle assembly supporting the yoke frame, the pinion gear assembly and the motor.

According to another embodiment of a snow rake system according to the present invention, an axle extends through the yoke frame and the system includes two wheels, one wheel rotatably coupled to each end of the axle.

According to again another embodiment of a snow rake system according to the present invention, the system includes a sheet of material coupled to and extending proximally from the axle.

According to still another embodiment of a snow rake system according to the present invention, the motor drives the pinion gear assembly to create an actuation motion of the rake head.

According to yet another embodiment of a snow rake system according to the present invention, the sheet is made of polyethylene.

According to a further embodiment of a snow rake system according to the present invention, the sheet is configured to be wrapped around the axle to form a sheet roll.

According to a still further embodiment of a snow rake system according to the present invention, the system includes a housing encasing the pinion gear assembly and motor.

According to a still further embodiment of a snow rake system according to the present invention, the pinion gear assembly includes a reciprocating assembly operatively coupled to the yoke frame, a ring gear operatively coupled to the reciprocating assembly, a pinion gear operatively coupled to the ring gear, and a flex shaft operatively coupled to both the pinion gear and motor.

According to a still further embodiment of a snow rake system according to the present invention, the ring gear is coupled to the housing by a first mounting member and the pinion gear is coupled to the housing by a second mounting member.

According to a still further embodiment of a snow rake system according to the present invention, the handle assembly includes a plurality of sections, each section configured to be removably coupled to another section.

According to a still further embodiment of a snow rake system according to the present invention, the plurality of handle assembly sections comprises three sections.

According to a still further embodiment of a snow rake system according to the present invention, the motor is a direct current electric motor.

According to a still further embodiment of a snow rake system according to the present invention, the motor drives the actuation of the rake head at a constant speed.

According to a still further embodiment of a snow rake system according to the present invention, the motor is a hand crank.

According to a still further embodiment of a snow rake system according to the present invention, the pinion gear assembly includes a flex shaft operatively coupled to the motor, a drive shaft operatively coupled to the flex shaft, a pinion gear operatively coupled to the drive shaft, a disc gear operatively coupled to the pinion gear, and a crank and slider linkage operatively coupled to both the disk gear and the yoke frame.

An embodiment of a method for clearing snow from the roof of a building according to the present invention includes the step of providing a snow rake system including a distal rake head including a plurality of cutting bars fixed to a yoke frame, a pinion gear assembly having a rotational input side and a linear output side, the linear output side operatively coupled to the yoke frame, a motor operatively coupled to the rotational input side, a proximal handle assembly comprising a plurality of sections and supporting the yoke frame, the pinion gear assembly and the motor, an axle extending through the yoke frame, two wheels, one wheel rotatably coupled to each end of the axle, and a sheet of material coupled to and extending proximally from the axle, wherein the sheet is configured to wrap around the axle to form a sheet roll. The method further includes the steps of assembling the snow rake system, placing the snow rake system near the lowest roof edge of a building, activating the motor, and pushing the rake head up the roof.

According to another embodiment of a method for clearing snow from the roof of a building according to the present invention, the assembling step further includes the steps of choosing the number of handle assembly sections needed and pairing the sections to the pinion gear assembly and motor.

According to another embodiment of a method for clearing snow from the roof of a building according to the present invention, the assembly step further includes the step of unraveling the sheet roll.

According to still another embodiment of a method for clearing snow from the roof of a building according to the present invention, the pushing step further includes the step of engaging a trigger to activate a reciprocating motion of the rake head.

According to yet another embodiment of a method for clearing snow from the roof of a building according to the present invention, the method further includes the step of moving from a first position to a second position as the rake head is pushed up the roof.

DESCRIPTION OF THE PREFERRED EMBODIMENT

Although the disclosure hereof enables those skilled in the art to practice the invention, the embodiments described merely exemplify the invention which may be embodied in other ways. While the preferred embodiment has been described, the details may be changed without departing form the invention.

Figure 1:
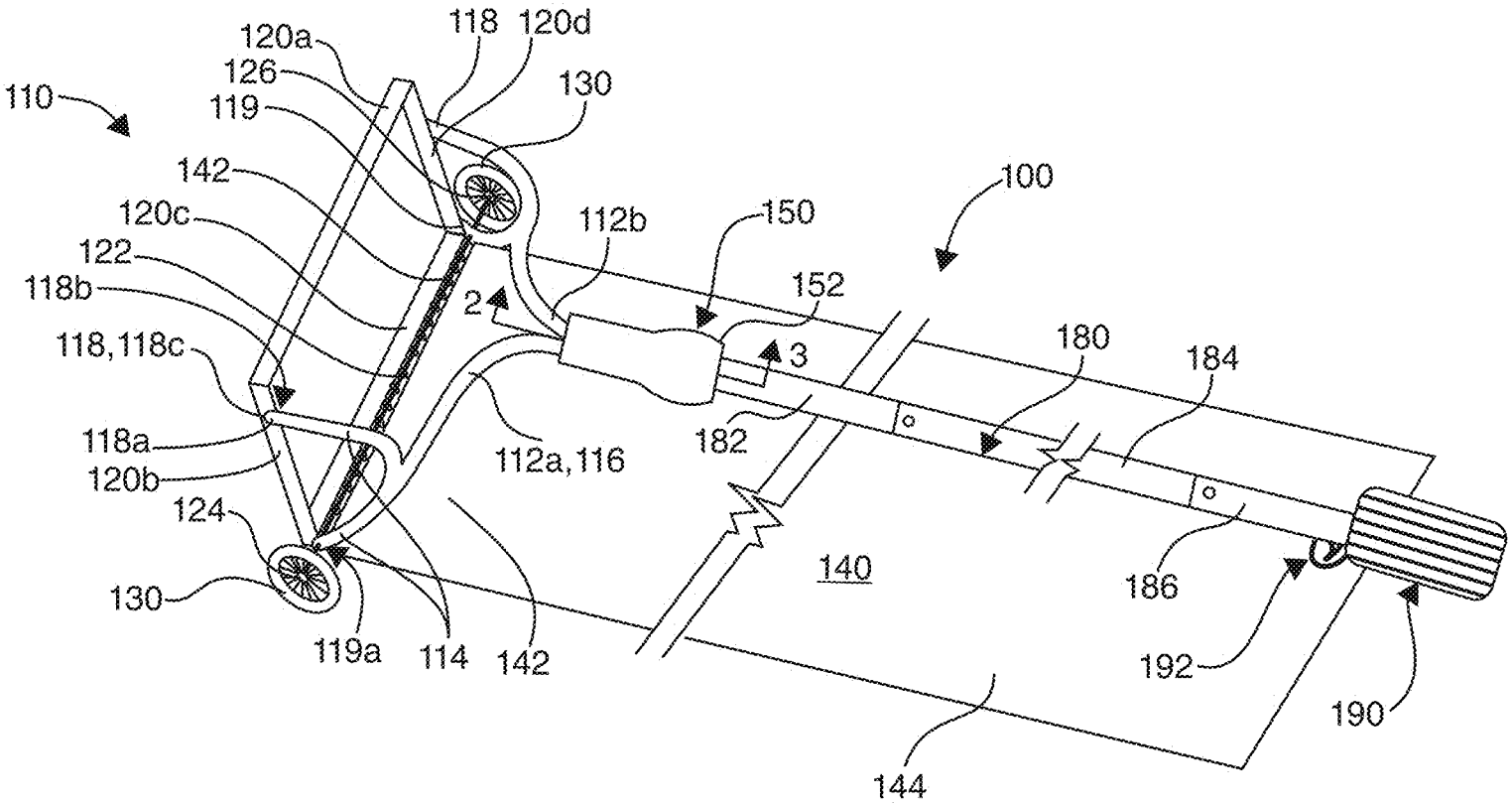
FIG. 1 is a perspective view of a snow rake device according to the present invention.
Figure 2:
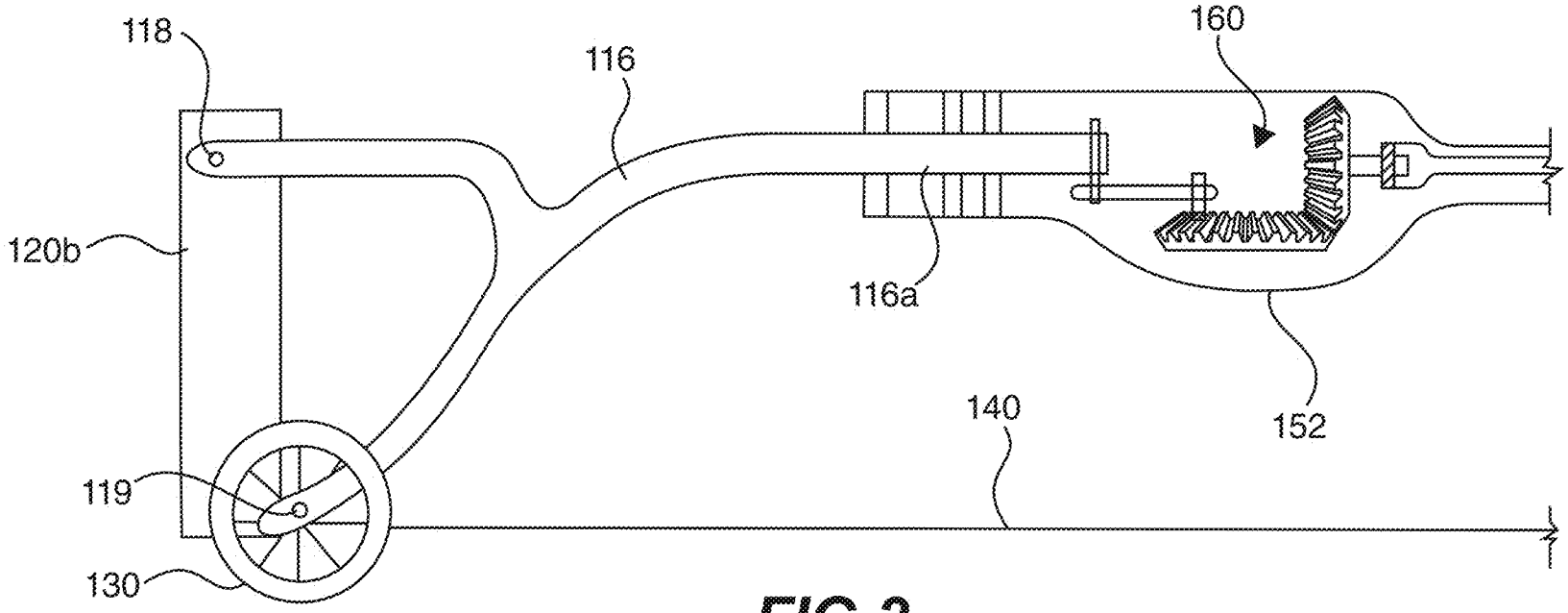
FIG. 2 is a left side elevation view of a rake head and partial cross section of an attached gear assembly according to the present invention.
Figure 3:
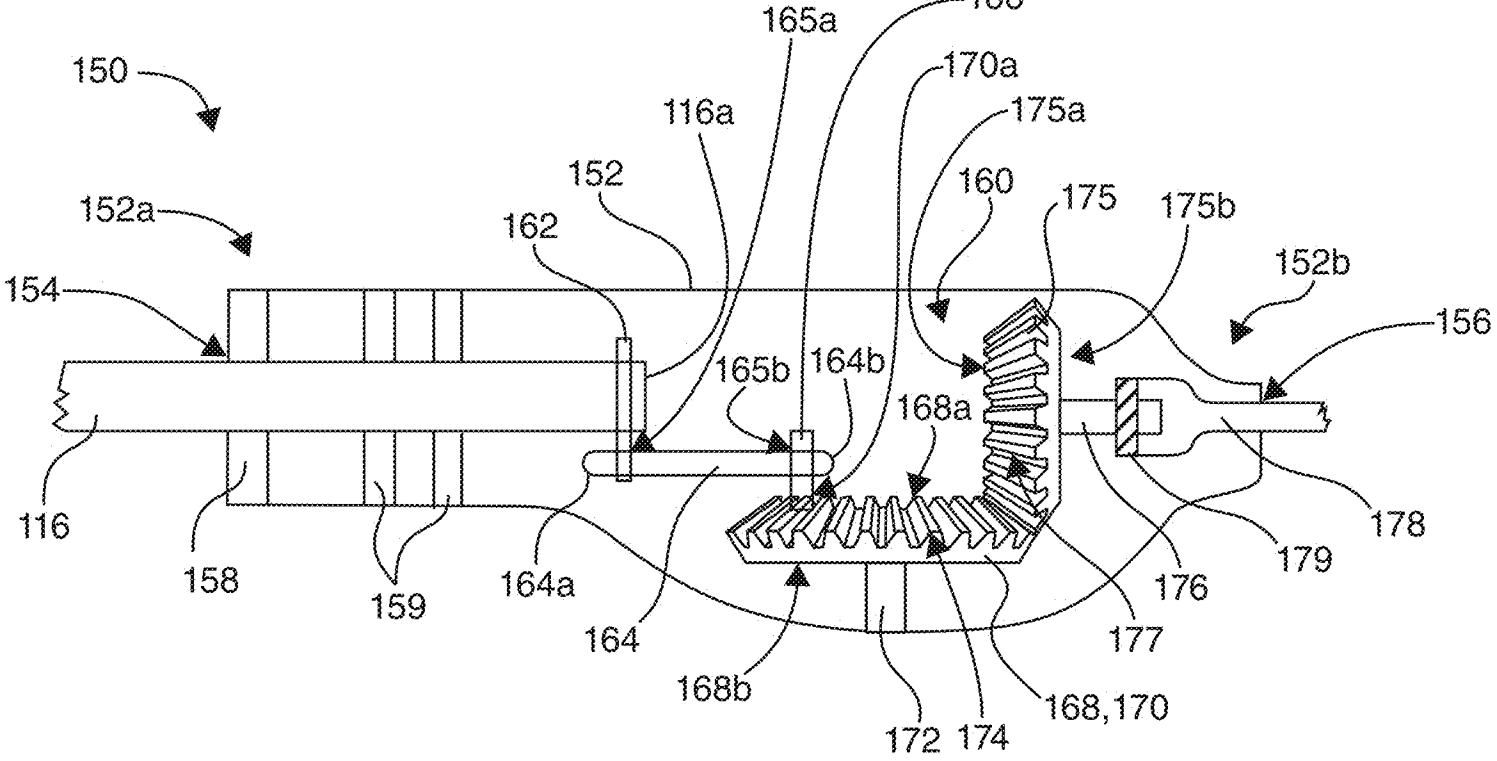
FIG. 3 is a left side enhanced view of a gear assembly according to the present invention.

Turning now to the figures, a snow rake device 100 with a motor and reciprocating frame can be seen in FIG. 1. The snow rake 100 generally comprises a handle assembly 180 with an attached motor 190 paired to a rake head 110 through a gear assembly 150. When snow may accumulate on a roof (especially a sloped roof) of a building, the snow rake 100 may be used to clear snow off the roof safely and without physically demanding movements by a user. Although best suited for buildings having sloped roofs (e.g., 1/12 to about 2 1/12), the snow rake 100 may also be employed for loosening or clearing snow from other buildings or even along the ground.

The rake head 110 comprises a yoke frame 112 with attached cutting bars 120, and further includes wheels 130, which may be individually rotatably coupled to the frame 112 or secured to an axle 122. The axle 122 may serve as a roll holder for a chute or sheet material 140, further described below. The frame 112 may be made of any durable material, such as metal (aluminum, steel, etc.) or hard plastic (PVC), so as to withstand wear during use and storage. Preferably, the frame 112 comprises tubular members (i.e. the frame members 112*a*,112*b* have a circular cross section), that may be hollow or solid. The frame 112 preferably comprises two separate sides 112*a,b* of this material (which may be at least substantially identical), bent in substantially mirrored ways, that are paired through a fastener (i.e. nail, pin, etc.) located at the shaft ends 116*a*. Each piece 112*a*-112*b* of the frame 112 is preferably substantially shaped as a wishbone, wherein wings 114 branch from a main shaft 116 and terminate at the first frame end 118 and the second frame end 119.

The frame ends 118,119 terminate the wings 114 of each side 112*a,b* of the frame 112. Each frame end 118,119 may be flattened, such that the cross sections of the frame ends 118,119 are substantially rectangular or discorectangular and the flattened ends may be easily paired with other parts using fasteners, such as nuts, washers, and bolts. Each frame end 118,119 includes an inside portion 118*a*,119*a*, an outside portion 118*b*,119*b*, and an aperture 118*c*-119*c* extending therethrough. The frame ends 118,119 act as pairing points for the cutting bars 120 and wheels 130, respectively.

The cutting bars 120 are preferably solid portions of flattened, durable metal (e.g., steel or aluminum) that are either bent or welded into an open shape (e.g., rectangle, trapezoid, or square), forming sides 120*a*-120*d*. The first end 118 of each frame piece 112*a*-112*b* is paired to one side 120*b* or 120*d* of the through the use of a fastener (e.g., nut/bolt) or otherwise secured thereto, such as by welding or adhesive. The first ends 118 are preferably paired to opposite sides 120*b*,120*d* which are those that are disposed at least substantially perpendicular to a roof when the snow rake 100 is in use.

The axle 122 may be made of the same or similar material as the frame 112 and is preferably a solid rod or hollow tube, preferably unbent and having a circular cross-section. The axle 122 includes a first end 124 and second end 126, with a length 128 defined as the distance between the ends 124-126. The axle 122 preferably has a smaller cross-sectional radius than the frame 112 and preferably a sufficiently small radius to fit through the apertures 119*c* in the second frame ends 119. That is, in use, the axle 122 preferably extends through the apertures 119*c*, such that the first end 124 of the axle 122 is proximate the second frame end 119 of the first frame piece 112*a* and the second end of the axle 122 is proximate the second frame end 119 of the second frame piece 112*b*. The axle length 128 is preferably greater than the length of space between the second frame ends 119 of the frame pieces 112*a*-112*b*, such that the first end 124 of the axle 122 may pass through the second frame end aperture 119*c* of the first frame piece 112*a* and extend for a small length and the second end 126 of the axle 122 may pass through the second frame end aperture 119*c* of the second frame piece 112*b* and extend for a similar or the same length.

These small lengths of axle 122 that extend beyond the space between the two second frame ends 119 are configured to pair with the wheels 130. Each wheel 130 is rotatably disposed over the axle 122 proximate one of the outside portions 119*b* of the second frame ends 119. The wheels 130 preferably rotate about an axis located at the center of the cross-sectional circle of the axle 122. The wheels 130 preferably fit loosely around the axle 122, such that the wheels 130 are free to rotate substantially unhindered thereabout. The wheels 130 may be held in place by fasteners (e.g. nuts, washers, etc.), so as not to move along the axle length 128 during use. Alternatively, the axle 122 may rotate within the frame ends 119 and the wheels 130 could be relatively immovably secured to the axle 122.

Attached to, and subsequently wrapped around, the axle 122 is a sheet 140, preferably made from a durable material such as polyethylene. A sheet first end 142 is attached to the axle 122, preferably through the use of a plurality of rings (as shown) (or adhesive or attachment device (e.g. tape) if the axle is stationary). For storage, the sheet 140 may be continuously wrapped around the axle 122 to form a sheet roll 146. In use, a sheet second end 144 may be pulled to unravel the roll 146 and extend the sheet 140, preferably to its full length prior to use.

When the snow rake 100 is assembled, the frame pieces 112*a*-112*b* are positioned such that the shaft ends 116*a* may be paired together using a fastener. The shaft ends are also preferably paired with a gear box assembly 150 comprising a reciprocator 160 encased within a housing 152. The housing 152 is preferably made of a tough, durable material, capable of withstanding wear during use, maintenance, and storage (e.g. aluminum or hard plastic) that protects the reciprocator 160 located within. The housing 152 preferably includes a frame aperture 154 in the rake head side 152*a* of the housing 152 and a flex shaft aperture 156 in handle assembly side 152*b* of the housing 152. The housing also preferably includes a seal 158 and bracings 159, located within the housing 152 proximate the frame aperture 154. When assembled, the paired frame shaft ends 116*a* are inserted into the frame aperture 154, through the seal 158 and bracings 159. The seal 158 and bracings 159 help to hold the paired shaft ends 116*a* in place while the snow rake 100 is in use, and the seal 158 preferably at least substantially prevents ingress of snow, dirt, and/or water.

The reciprocator 160 is an assembly preferably comprising a reciprocator pin 162, a reciprocating linkage 164, an anchor pin 166, a ring gear 168, a pinion gear 175, and a flex shaft 178. When the paired shaft ends 116*a* are inserted into the gear assembly housing 152, the shaft ends 116*a* may be connected to the reciprocator 160 through the use of the reciprocator pin 162.

The reciprocator pin 162 is preferably a cylindrical pin formed from a material including a sheer strength that can withstand the reciprocating movements of the snow rake 100 during use. In assembly, the reciprocator pin 162 is used to pair the frame shaft ends 116*a* with the reciprocator 160, such as through threading on both the reciprocator pin 162 or by an adhesive or weld, such that the reciprocator pin 162 may not appreciably slide, twist, or otherwise move apart from the shaft ends 116*a* once paired. Preferably, the reciprocator pin 162 has a sufficient length to be received within the reciprocator linkage 164 (secured or rotatably), mechanically connecting the shaft ends 116*a* to the reciprocator linkage 164.

The reciprocating linkage 164 is preferably a rectangular (e.g., parallelepiped or bar) or discorectangular shaped piece of durable material (or other shape sufficient to transfer linear forces), such as metal (e.g. steel), including a first end 164*a* and a second end 164*b*. Preferably, the linkage 164 includes two pin holes 165 that extend through the linkage 164 completely in a direction perpendicular to the linear force direction to be transferred by the linkage 164. Preferably, one pin hole 165 is located proximate each linkage end 164*a*,164*b* (e.g., closer to one end than the other). The pin hole 165 located proximate the first end 164*a* is preferably configured that the reciprocator pin 162 may be fitted into the first end pin hole 165*a* using threading or an adhesive (or alternatively rotatably fitted therein). The second end pin hole 165*b*, however, preferably includes no threading or adhesive. Instead, the anchor pin 166 is rotatably disposed in the second end pin hole 165*b* to allow the anchor pin 166 to rotate independently in the linkage 164.

The anchor pin 166 is similar or identical in material and function to the reciprocator pin 162. However, when rotatably disposed within the second end pin hole 165*b*, the anchor pin 166 should be able to twist independently of the linkage 164, for reasons described later. Further, the anchor pin 166 preferably reaches beyond the reciprocating linkage 164 and secured into the proximately disposed ring gear 168.

The ring gear 168 is preferably a ring gear known in the art, having a solid body 170 with a top surface 168*a*, bottom surface 168*b*, and toothed surface 174. The anchor pin 166 is preferably permanently or rotatably fixed into an anchor pin hole 170*a* in the top surface 168*a* of the ring gear 168 through an adhesive or knurled texture on the anchor pin 166 and anchor pin hole 170*a*. The ring gear 168 is preferably frustoconical, wherein the ring gear bottom surface 168*b* is preferably flat and rotatably affixed to a mounting 172 on the housing 152 interior. The ring gear top surface 168*a* is preferably substantially flat and includes the anchor pin hole 170*a* into which the anchor pin 166 is fixedly or rotatably disposed, as described above. The anchor pin hole 170*a* preferably does not reach through the ring gear body 170. Rather, the anchor pin hole 170*a* may be a reentrant bore having a depth sufficient to allow the anchor pin 166 to be adequately fixed or otherwise operatively disposed into the ring gear body 170. The ring gear 168 of the present invention may be made by drilling an anchor pin hole 170*a* as described above into a ring gear known in the art.

Disposed proximate the ring gear 168, and preferably disposed substantially perpendicularly thereto, the pinion gear 175 is preferably a pinion gear known in the art. The pinion gear 175 preferably includes a substantially flat front surface 175*a* and opposite back surface 175*b* and a frustoconical toothed surface 177 extending therebetween. The pinion gear back surface 175*b* preferably includes a leg 176, which may be paired with the flex shaft 178. The ring gear toothed surface 174 and the pinion gear toothed surface 177 are preferably configured to mate together, such that when the pinion gear 175 is rotated, the ring gear 168 rotates as well, each about a respective preferably at least substantially coplanar axis that is disposed approximately 90 degrees from the other.

The flex shaft 178 may be one well known in the art. Preferably the flex shaft 178 includes a jawed chuck 179 configured to receive the pinion gear leg 176. In this way, the flex shaft 178 may mechanically transfer rotation to the gear assembly 150 ultimately causing linear reciprocation of the cutting bars 120. The flex shaft 178 extends from the jawed chuck 179 through the housing flex shaft aperture 156 into the interior of the handle assembly 180. Optionally, the flex shaft 178 may have an extendable design to increase the length of the flex shaft 178 in the event a longer handle assembly 180 is desired.

Figure 4:
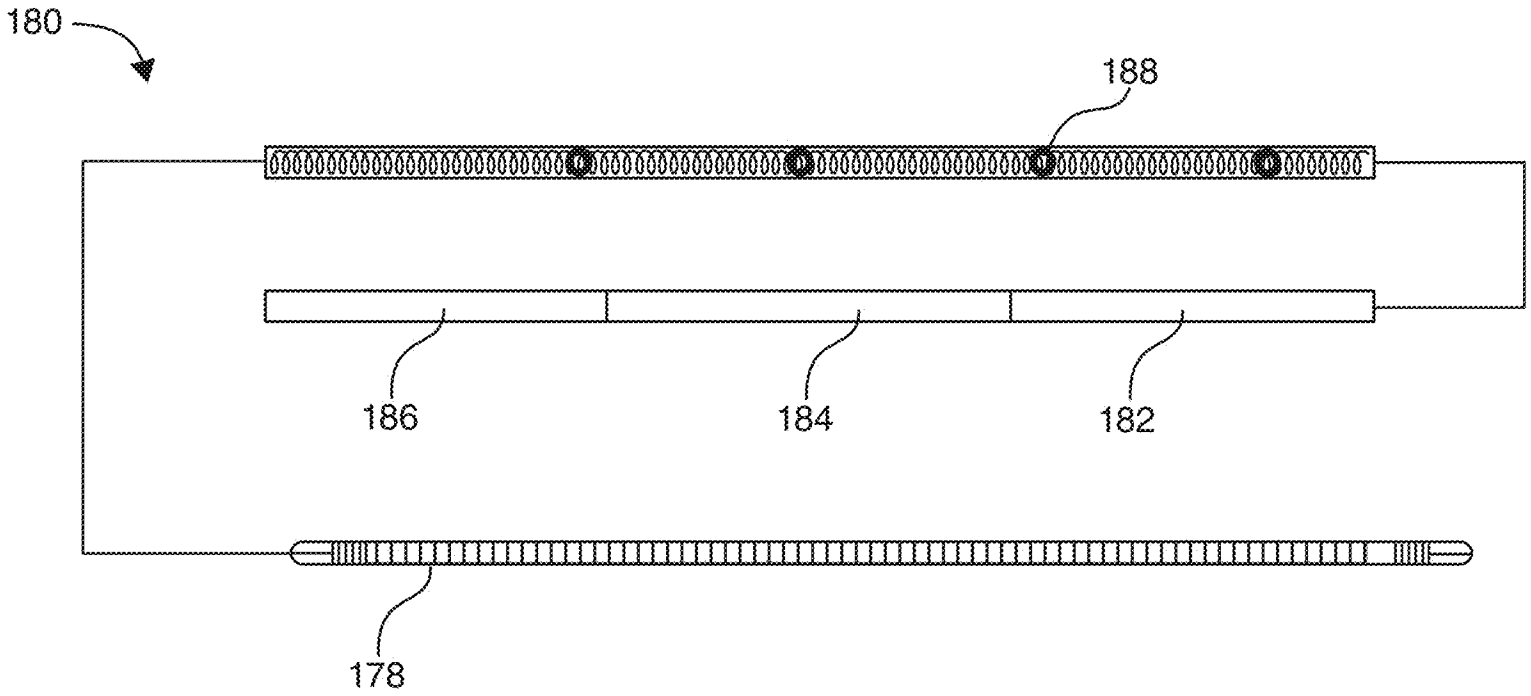
FIG. 4 is top view of a handle assembly according to the present invention.

The handle assembly 180 is preferably made up of three sections 182,184,186, although alternate embodiments may feature more or less handle assembly sections. Each section is preferably made of the same metal or hard plastic material (e.g., aluminum or PVC), and each section may be at least substantially identical. The sections 182,184,186 are preferably configured to be removably paired together, such that a user may attach as many handle sections as desired. By including more handle sections, the reach of the snow rake 100 may be extended. Each section 182,184,186 is preferably shaped as a hollow cylinder with a circular cross section, allowing the flex shaft 178 to be disposed therein. The handle assembly first section 182 is preferably paired with the gear assembly housing 152 through the use of a fastener (i.e. screw or clamp). The second section 184 is preferably paired with both the first section 182 and the third section 186 through fasteners (i.e. screws or clamps). Finally, the third section 186 is further paired to a drive shaft of a motor 190 through a fastener (i.e. screw or clamp). The handle assembly 180 may optionally include a flex shaft stabilizer 188, which further protects the flex shaft 178 and handle assembly sections 182-186 from damage during use and storage. The stabilizer 188 may be in the form of a sleeve between the flex shaft 178 and the handle sections 182-186, as seen in FIG. 4.

The motor 190 may be a motor known in the art, such as a gas or diesel motor commonly used with leaf blowers or lawnmowers. Alternatively, the motor 190 may be an electric motor, such as a DC motor powered by a portable and rechargeable battery (e.g., lithium-ion battery). The motor 190 drives the actuation movements of the rake head 110, as described below. Optionally, a trigger 192 may be provided to control activation and/or deactivation of the motor 190 and/or the speed of motor 190, and in turn the actuation of the rake head 110. Otherwise, the motor 190 may drive the rake head 110 actuation at a constant speed. In alternative embodiments, the motor 190 may be in the form of a hand crank, where the user manually creates rotation of the flex shaft 178.

Figure 5:
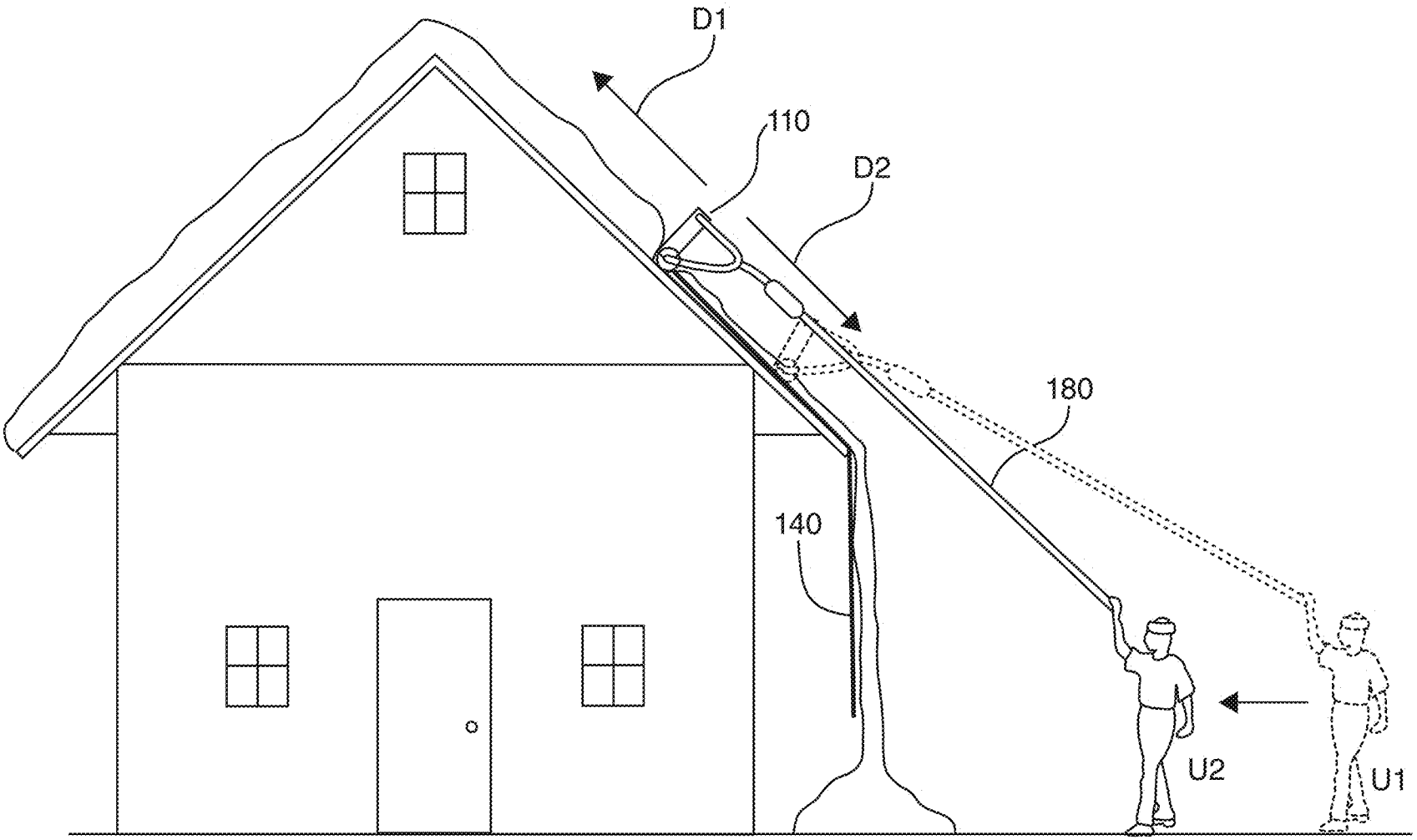
FIG. 5 is an elevation view of an embodiment according to the present invention in use.

With reference to FIG. 5, the snow rake 100 of the present invention may be used to clear snow from a roof of a building. First, a user may decide the number of handle assembly 180 sections needed and pairs the sections to the gear assembly 150 and motor 190. The user unravels the sheet 140 from the sheet roll 146, or if already unrolled then simply stands at a first position U1 and places the rake head 110 on a roof near a lowest roof edge of a building. The user may then activate the motor 190, which drives the flex shaft 178 to rotate. As the flex shaft 178 is connected to the pinion gear 175, the pinion gear 175 also begins to rotate and thereby causes the ring gear 168 to rotate as well. As the ring gear 168 rotates, the anchor pin 166 is drawn in a circular motion, traveling approximately 1-2" from its starting position.

Since the anchor pin 166 is fitted into the second end pin hole 165*b* of the linkage 164, the movement of the anchor pin 166 also causes the linkage 164 to move. However, as the anchor pin 166 is not permanently fixed within the second end pin hole 165*b* (i.e. the anchor pin 166 may freely rotate within the second end pin hole 165*b*), the linkage 164 itself may not rotate. Rather, as the anchor pin 166 moves in its circular pattern, it pulls the linkage 164 into a reciprocating, linear movement pattern, thereby transferring the rotational motion of the flex shaft 178 into linear motion in a first direction D1 and an opposite second direction D2. This type of motion transfer is well known within the art.

As the linkage 164 moves in its reciprocal linear motion pattern, the attached shaft ends 116*a* of the rake frame 112 are moved as well, causing the entire rake head 110 to move with the same reciprocal motion. As the user pushes the snow rake 100 up the roof, made easier by the wheels attached to the rake head 110, snow may pass through the open rectangular or square oriented cutting bars 120 and slide down the sheet 140 to the ground. When the user reaches an area of snow or ice that proves difficult to clear, the user may engage the trigger 192, activating the reciprocating motion of the rake head 110, which helps to break up compiled snow on the roof. In particular, the cutting bars 120 may help to break through compacted snow layers and/or ice chunks that may prove difficult to clear by only manual manipulation of the rake 100. In this way, embodiments of devices according to the present invention may not require a user to physically overly exert themselves to clear tough areas of snow and/or ice from a roof.

Figure 6:
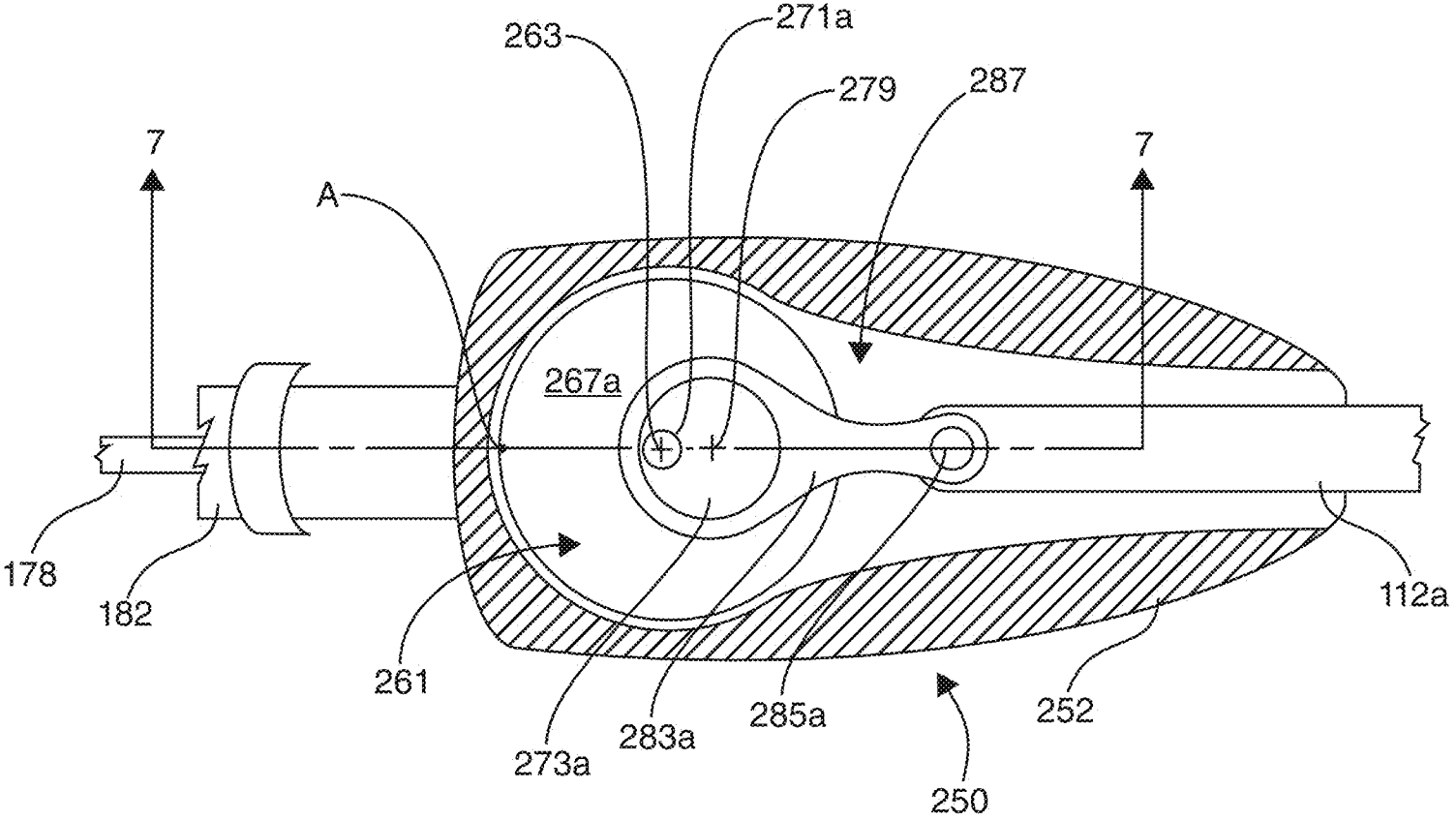
FIG. 6 is a partial cutaway left side elevation view of an alternative embodiment of a gear assembly according to the present invention.
Figure 7:
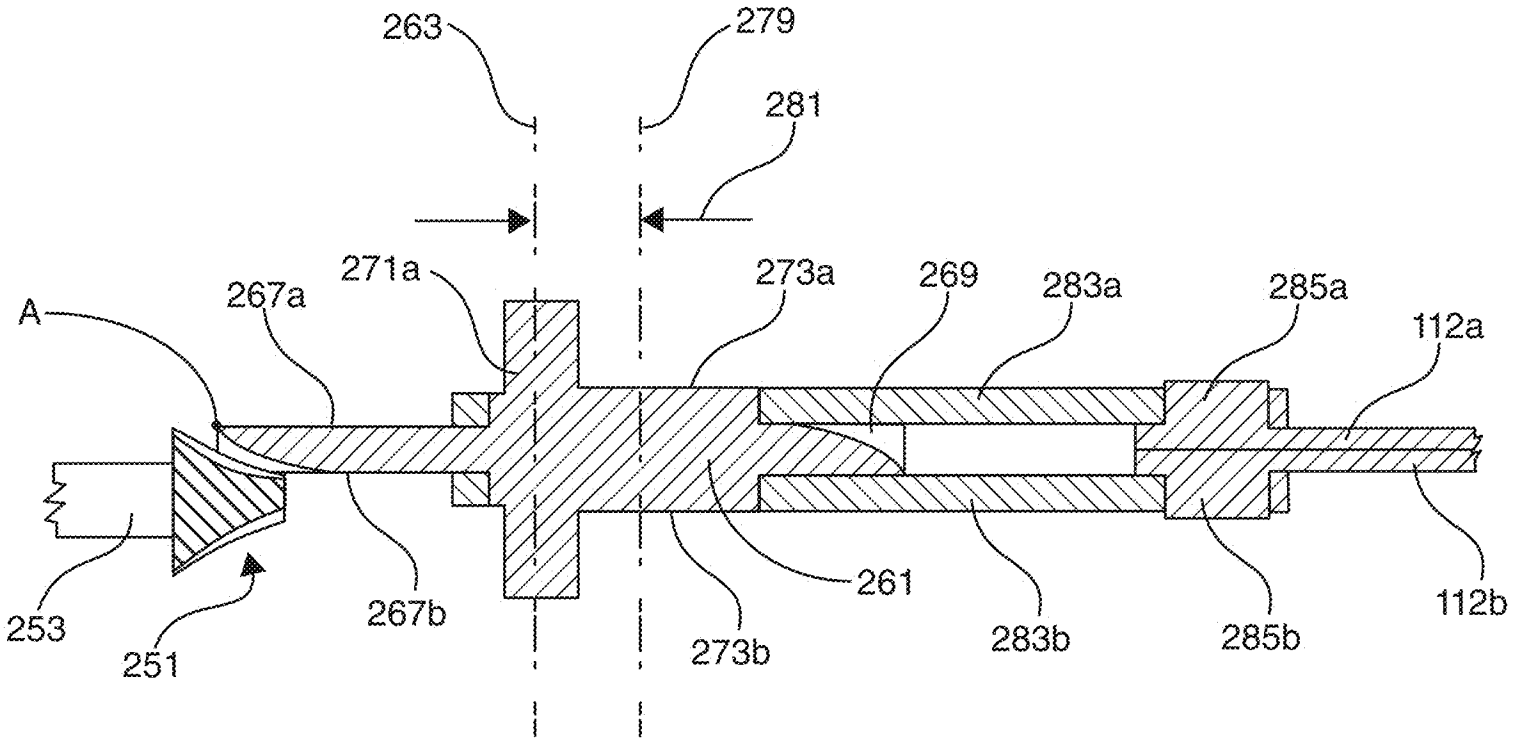
FIG. 7 is a partial cross-section view taken along line 7-7 of FIG. 6.
Figure 8:
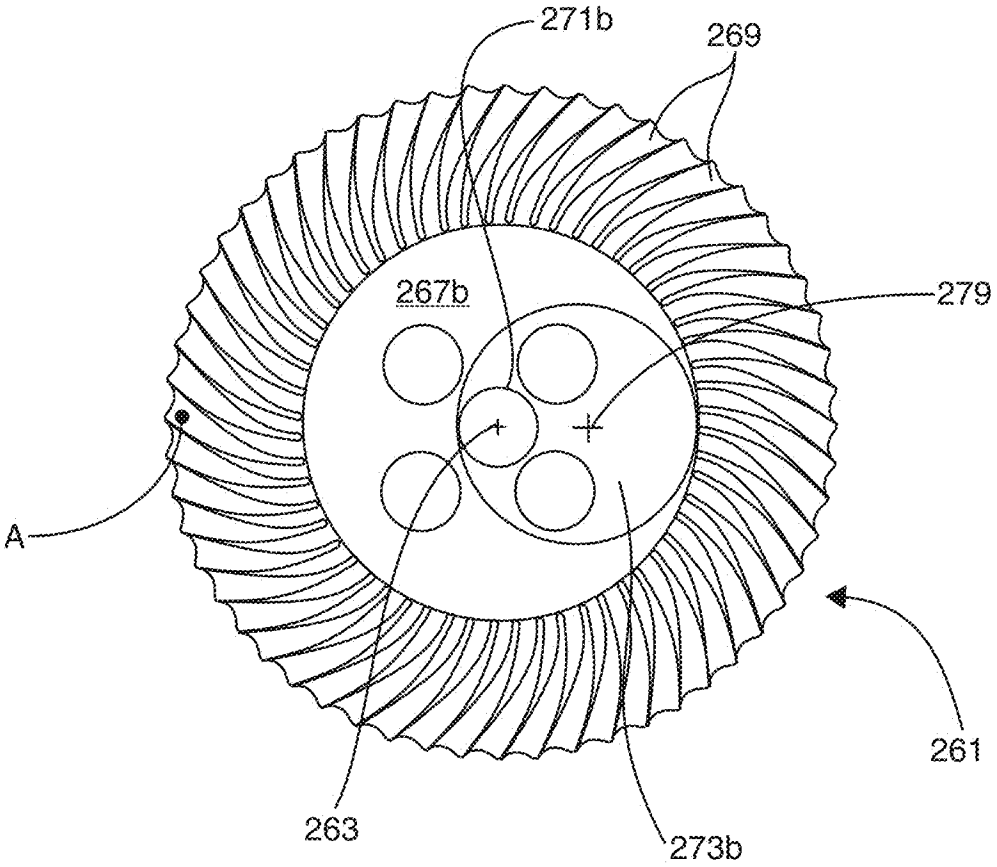
FIG. 8 is a right side elevation view of a disc gear according to the embodiment shown in FIG. 6.

FIG. 6 provides an alternative embodiment of a gear assembly 250 according to the present invention. Generally, the gear assembly 250 is contained within a housing 252, which may be a two-piece (or more) housing with a selectively removable cover. The assembly 250 translates rotational power provided by the flex shaft 178 into an oscillating linear movement of the rake head 110. With further reference to FIG. 7 and FIG. 8, the assembly 250 includes a pair of spiral bevel gears, namely a pinion gear 251 meshed with a disc gear 261. The pinion gear 251 is secured to a drive shaft 253 which receives power from a flex shaft 178 powered by a motor 190. Rotation of the pinion gear 251 causes a rotation of the disc gear 261 about a disc gear axis 263. Reference point A is provided on the periphery of the disc gear 261 so that orientation is clear throughout the discussion.

The disc gear 261 generally has a first surface 267*a*, which is preferably at least substantially planar, and a second surface 267*b*, which is preferably at least substantially planar and parallel to the first surface 267*a*, proximate the disc gear axis 263. However, on or into the second surface 267*b*, about the periphery of the preferably circular disc gear 261, are formed a plurality of conical spiral gear teeth 269, which are configured to cooperate with the pinion gear 251. Extending from the first surface 267*a*, coaxial with the disc gear axis 263, is a first axle portion 271*a*. Extending from the second surface 267*b*, coaxial with the disc gear axis 263, is a second axle portion 271*b*. The axle portions 271 are configured to be rotatably received within bearings (not shown) disposed within the housing 252. Also extending from each disc gear surface 267 is a cylindrical bearing stub 273*a,b* each formed preferably coaxial about a stub axis 279. The stub axis 279 is preferably at least substantially parallel to the disc gear axis 263 and spaced therefrom by a half-cycle distance 281.

Generally, a crank and slider linkage translates the rotational motion of the disc gear 261 to the frame 112 of the rake head 110. To form such linkage, disposed about the first stub 273*a* is a portion of a first connecting rod 283*a*, preferably forming a plain bearing surface within which the first stub 273*a* rotates. Likewise, disposed about the second stub 273*b* is a portion of a second connecting rod 283*b*, preferably forming a plain bearing surface within which the second stub 273*b* rotates. A second portion of each connecting rod 283 preferably rotatably receives a respective slider pin 285, which is secured to the frame 112 of the rake head 110. When secured within the housing 252, the connecting rods 283 may be held in place by strike plates (not shown), also in the housing 252, which allow sufficient clearance within a housing cavity 287 for the desired component movement.

In this way, the flex shaft 178 is selectively rotated by the motor 190, which rotates the pinion gear 251. The pinion gear 251 interfaces with the spiral teeth 269 on the disc gear 261, causing the disc gear 261 to rotate about the disc gear axis 263. As the disc gear 261 rotates, the stub axis 279 also revolves around the disc gear axis 263, causing the frame 112 to move from a distal half-cycle distance 281 in the position shown in FIG. 6 and FIG. 7, to a proximal half-cycle distance 281 when the disc gear 261 has rotated 180 degrees from the position shown. Thus, the total linear travel of the frame 112 will be substantially equal to twice the half-cycle distance 281 for each half rotation of the disc gear 261, oscillating between a distal position and a proximal position. A half-cycle distance 281 of about 0.25 inches to about 1.0 inch is preferred with about 0.3 inches to about 0.5 inches being more preferred.

The foregoing is considered as illustrative only of the principles of the invention. Furthermore, because numerous modifications and changes will readily occur to those skilled in the art, it is not desired to limit the invention to the exact construction and operation shown and described. While the preferred embodiment has been described, the details may be changed without departing from the invention.

What is claimed is:

1. A snow rake system comprising:

a distal rake head including a plurality of cutting bars fixed to a yoke frame;

a pinion gear assembly having a rotational input side and a linear output side, the linear output side operatively coupled to the yoke frame;

a motor operatively coupled to the rotational input side; and a proximal handle assembly supporting the yoke frame, the pinion gear assembly and the motor.

2. The snow rake system according to claim 1, further comprising:

an axle extending through the yoke frame; and two wheels, one wheel rotatably coupled to each end of the axle.

3. The snow rake system according to claim 2, further comprising:

a sheet of material coupled to and extending proximally from the axle.

4. The snow rake system according to claim 1, wherein the motor drives the pinion gear assembly to create an actuation motion of the rake head.

5. The snow rake system according to claim 3, where the sheet is made of polyethylene.

6. The snow rake system according to claim 3, wherein the sheet is configured to be wrapped around the axle to form a sheet roll.

7. The snow rake system according to claim 3, further comprising:

a housing encasing the pinion gear assembly and motor.

8. The snow rake system according to claim 7, wherein the pinion gear assembly comprises:

a reciprocating assembly operatively coupled to the yoke frame;

a ring gear operatively coupled to the reciprocating assembly;

a pinion gear operatively coupled to the ring gear; and a flex shaft operatively coupled to both the pinion gear and motor.

9. The snow rake system according to claim 8, wherein the ring gear is coupled to the housing by a first mounting member and the pinion gear is coupled to the housing by a second mounting member.

10. The snow rake system according to claim 3, wherein the handle assembly comprises a plurality of sections, each section configured to be removably coupled to another section.

11. The snow rack system according to claim 10, wherein the plurality of sections comprises three sections.

12. The snow rack system according to claim 4, wherein the motor comprises a direct current electric motor.

13. The snow rack system according to claim 12, wherein the motor drives the actuation of the rake head at a constant speed.

14. The snow rack system according to claim 4, wherein the motor is a hand crank.

15. The snow rack system according to claim 7, wherein the pinion gear assembly comprises:

a flex shaft operatively coupled to the motor;

a drive shaft operatively coupled to the flex shaft;

a pinion gear operatively coupled to the drive shaft;

a disc gear operatively coupled to the pinion gear; and a crank and slider linkage operatively coupled to both the disk gear and the yoke frame.

16. A method for clearing snow from the roof of a building comprising the steps of:

providing a snow rake system comprising:

a distal rake head including a plurality of cutting bars fixed to a yoke frame;

a pinion gear assembly having a rotational input side and a linear output side, the linear output side operatively coupled to the yoke frame;

a motor operatively coupled to the rotational input side;

a proximal handle assembly comprising a plurality of sections and supporting the yoke frame, the pinion gear assembly and the motor;

an axle extending through the yoke frame;

two wheels, one wheel rotatably coupled to each end of the axle; and a sheet of material coupled to and extending proximally from the axle, wherein the sheet is configured to wrap around the axle to form a sheet roll;

assembling the snow rake system;

placing the snow rake system near the lowest roof edge of a building;

activating the motor; and pushing the rake head up the roof.

17. A method for clearing snow according to claim 16, wherein the assembling step comprises the step of: pairing the plurality of sections to the pinion gear assembly and motor.

18. A method for clearing snow according to claim 17, wherein the assembly step further comprises the step of unraveling the sheet roll.

19. A method for clearing snow according to claim 16, wherein the pushing step further comprises the step of engaging a trigger to activate a reciprocating motion of the rake head.

20. A method for clearing snow according to claim 19, further comprising the step of moving from a first position to a second position as the rake head is pushed up the roof.

* * * * *